US010720691B2

(12) United States Patent
Tayama et al.

(10) Patent No.: US 10,720,691 B2
(45) Date of Patent: Jul. 21, 2020

(54) FILM ANTENNA AND ANTENNA DEVICE

(71) Applicant: FUJIKURA LTD., Tokyo (JP)

(72) Inventors: Hiroiku Tayama, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 16/078,199

(22) PCT Filed: Feb. 21, 2017

(86) PCT No.: PCT/JP2017/006407

§ 371 (c)(1),
(2) Date: Aug. 21, 2018

(87) PCT Pub. No.: WO2017/169305

PCT Pub. Date: Oct. 5, 2017

(65) Prior Publication Data

US 2019/0051968 A1 Feb. 14, 2019

(30) Foreign Application Priority Data

Mar. 29, 2016 (JP) ..... 2016-066273

(51) Int. Cl.
*H01Q 9/26* (2006.01)
*H01Q 1/08* (2006.01)
(Continued)

(52) U.S. Cl.
CPC ..... *H01Q 1/085* (2013.01); *H01Q 5/371* (2015.01); *H01Q 9/26* (2013.01); *H01Q 1/3283* (2013.01); *H01Q 1/38* (2013.01)

(58) Field of Classification Search
CPC .. H01Q 1/08; H01Q 5/30–5/392; H01Q 9/26; H01Q 9/42; H01Q 1/38
See application file for complete search history.

(56) References Cited

U.S. PATENT DOCUMENTS 7,079,079 B2 * 7/2006 Jo ..... H01Q 1/243 343/700 MS
7,183,983 B2 2/2007 Ozden
(Continued)

FOREIGN PATENT DOCUMENTS

EP 0 777 295 A2 6/1997
EP 2 495 806 A2 9/2012
(Continued)

OTHER PUBLICATIONS

International Search Report dated May 16, 2017, issued in counterpart International Application No. PCT/JP2017/006407 (2 pages).
(Continued)

*Primary Examiner* — Dameon E Levi
*Assistant Examiner* — Hasan Z Islam
(74) *Attorney, Agent, or Firm* — Westerman, Hattori, Daniels & Adrian, LLP

(57) ABSTRACT

Provided is an antenna device which is less prone to deterioration in radiation characteristics and which can be mounted in a small space. A second antenna element (13) includes a first portion (13*a*) and a second portion (13*b*). A first antenna element (12) is disposed on a first plane (P1), the first portion (13*a*) is disposed on a second plane (P2), and the second portion (13*b*) is disposed on a third plane (P3). When viewed in a direction orthogonal to the first plane (P1), the second portion (13*b*) does not overlap the first antenna element (12) except at an end region (13*c*).

9 Claims, 8 Drawing Sheets

(51) Int. Cl.

| | |
|---|---|
| ***H01Q 5/371*** | (2015.01) |
| *H01Q 1/38* | (2006.01) |
| *H01Q 1/32* | (2006.01) |

(56) References Cited

U.S. PATENT DOCUMENTS

| | | | | |
|---|---|---|---|---|
| 2010/0039331 | A1 | 2/2010 | Tai | |
| 2010/0066615 | A1* | 3/2010 | Okayama | H01Q 1/243 343/702 |
| 2010/0271271 | A1 | 10/2010 | Wu | |
| 2010/0271272 | A1* | 10/2010 | Sung | H01Q 9/42 343/702 |
| 2012/0013510 | A1 | 1/2012 | Yagi et al. | |
| 2012/0092220 | A1 | 4/2012 | Tani et al. | |
| 2013/0057446 | A1* | 3/2013 | Hirobe | H01Q 1/243 343/851 |
| 2014/0292587 | A1* | 10/2014 | Yarga | H01Q 1/243 343/702 |
| 2014/0354484 | A1 | 12/2014 | Kashiwagi et al. | |
| 2015/0120189 | A1 | 4/2015 | Giometti et al. | |
| 2017/0098887 | A1 | 4/2017 | Chen | |

FOREIGN PATENT DOCUMENTS

| | | | |
|---|---|---|---|
| JP | 2005-130249 | A | 5/2005 |
| JP | 2007-235404 | A | 9/2007 |
| JP | 2009-153076 | A | 7/2009 |
| JP | 2011-78037 | A | 4/2011 |
| JP | 2013-162216 | A | 8/2013 |
| KR | 10-2006-0106294 | A | 10/2006 |
| WO | 2006/031170 | A1 | 3/2006 |

OTHER PUBLICATIONS

Decision to Grant a Patent dated Jan. 9, 2018, issued in counterpart Japanese Patent Application No. 2016-066273.

Extended (supplementary) European Search Report dated Mar. 13, 2019, issued in counterpart EP Application No. 17773853.1. (10 pages).

* cited by examiner

FILM ANTENNA AND ANTENNA DEVICE

TECHNICAL FIELD

The present invention relates to a film antenna having a plurality of resonance frequencies, and an antenna device.

BACKGROUND ART

Patent Literature 1 discloses a film antenna including a ground plate and an antenna element which are provided on a surface of a dielectric substrate (see FIG. 3 of Patent Literature 1).

There is also known a film antenna including an antenna element which is constituted by a plurality of sub-elements with different lengths. Such a film antenna can operate over a wide band, because it operates at a plurality of resonance frequencies corresponding to the respective lengths of the plurality of sub-elements.

In regard to such a film antenna, there has been a demand for reducing the space required for mounting the film antenna. In order to reduce such a space, it is preferable to employ a flexible substrate as the dielectric substrate and employ pieces of conductive foil as the ground plate and the antenna element. Such a film antenna can be mounted in a small space because it is bendable.

CITATION LIST

Patent Literature

[Patent Literature 1]
Japanese Patent Application Publication Tokukai No. 2007-235404 (Publication date: Sep. 13, 2007)

SUMMARY OF INVENTION

Technical Problem

The inventors of the present invention have found that, in a case where the above-described film antenna is bent, radiation characteristics of the film antenna deteriorate due to the proximity of antenna element's portions to each other, the proximity of ground plate's portions to each other, or the proximity of the antenna element to the ground plate.

The present invention was made in view of the above issue, and an object of the present invention is to provide a film antenna that operates at a plurality of resonance frequencies, that is less prone to deterioration in radiation characteristics and that can be mounted in a small space.

Solution to Problem

In order to attain the above object, an antenna device in accordance with an aspect of the present invention includes: a first antenna element; and a second antenna element, the second antenna element including a first portion and a second portion, the first portion having a first resonance frequency, the second portion having a second resonance frequency which is lower than the first resonance frequency, the first antenna element being disposed on a first plane, the first portion of the second antenna element being disposed on a second plane, and the second portion of the second antenna element being disposed on a third plane, the second plane intersecting the first plane, the third plane facing the first plane and intersecting the second plane, when the first antenna element is viewed from a direction orthogonal to the first plane, the second portion of the second antenna element not overlapping the first antenna element except at an end region of the second portion, the end region being one of opposite end portions, which is farther from the first portion, of the second portion.

Advantageous Effects of Invention

An embodiment of the present invention makes it possible to provide a film antenna that operates at a plurality of resonance frequencies, that is less prone to deterioration in radiation characteristics and that can be mounted in a small space.

BRIEF DESCRIPTION OF DRAWINGS (a) of FIG. 1 is a perspective view of an antenna device including a film antenna in accordance with an embodiment of the present invention. (b) of FIG. 1 is a development of the film antenna illustrated in FIG. 1. (c) of FIG. 1 shows a plan view, a right side view, and a cross sectional view of the film antenna.

FIG. 2 is a perspective view of a support of the antenna device illustrated in FIG. 1.

(a) of FIG. 3 is a development of Variation 1 of the film antenna illustrated in FIG. 1. (b) of FIG. 3 is a plan view of the film antenna illustrated in (a) of FIG. 3.

(a) of FIG. 4 is a development of Variation 2 of the film antenna illustrated in FIG. 1. (b) of FIG. 4 is a plan view of the film antenna illustrated in (a) of FIG. 4.

(a) of FIG. 5 is a perspective view of a vehicle body which includes a spoiler having the antenna device illustrated in FIG. 1 therein. (b) of FIG. 5 is a perspective view of the spoiler.

(a) of FIG. 6 is a development of an Example of the film antenna illustrated in FIG. 1. (b) of FIG. 6 is a development of an Example of the film antenna illustrated in FIG. 3.

DESCRIPTION OF EMBODIMENTS (Antenna Device 1)

Figure 1:
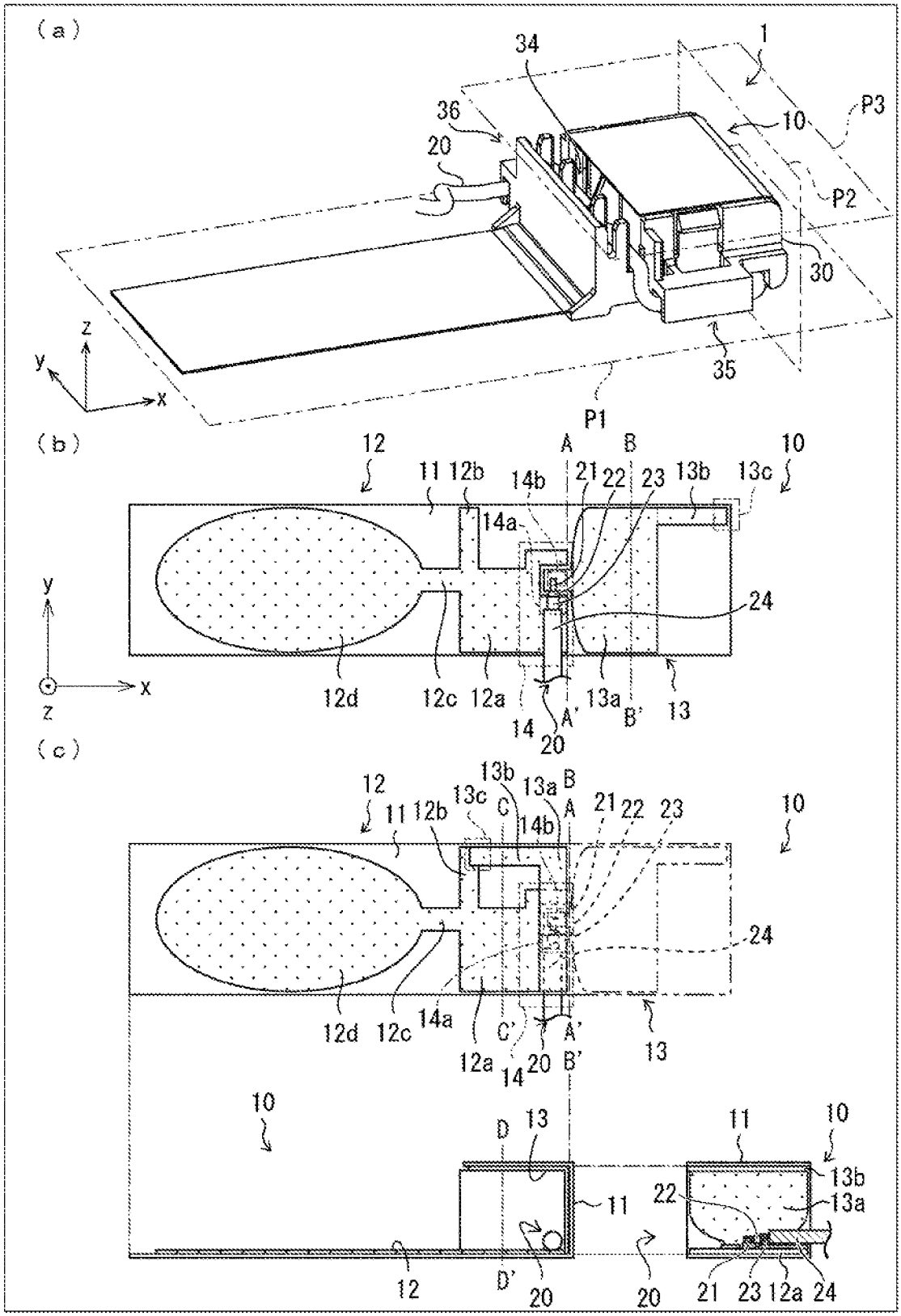
Figure 2:
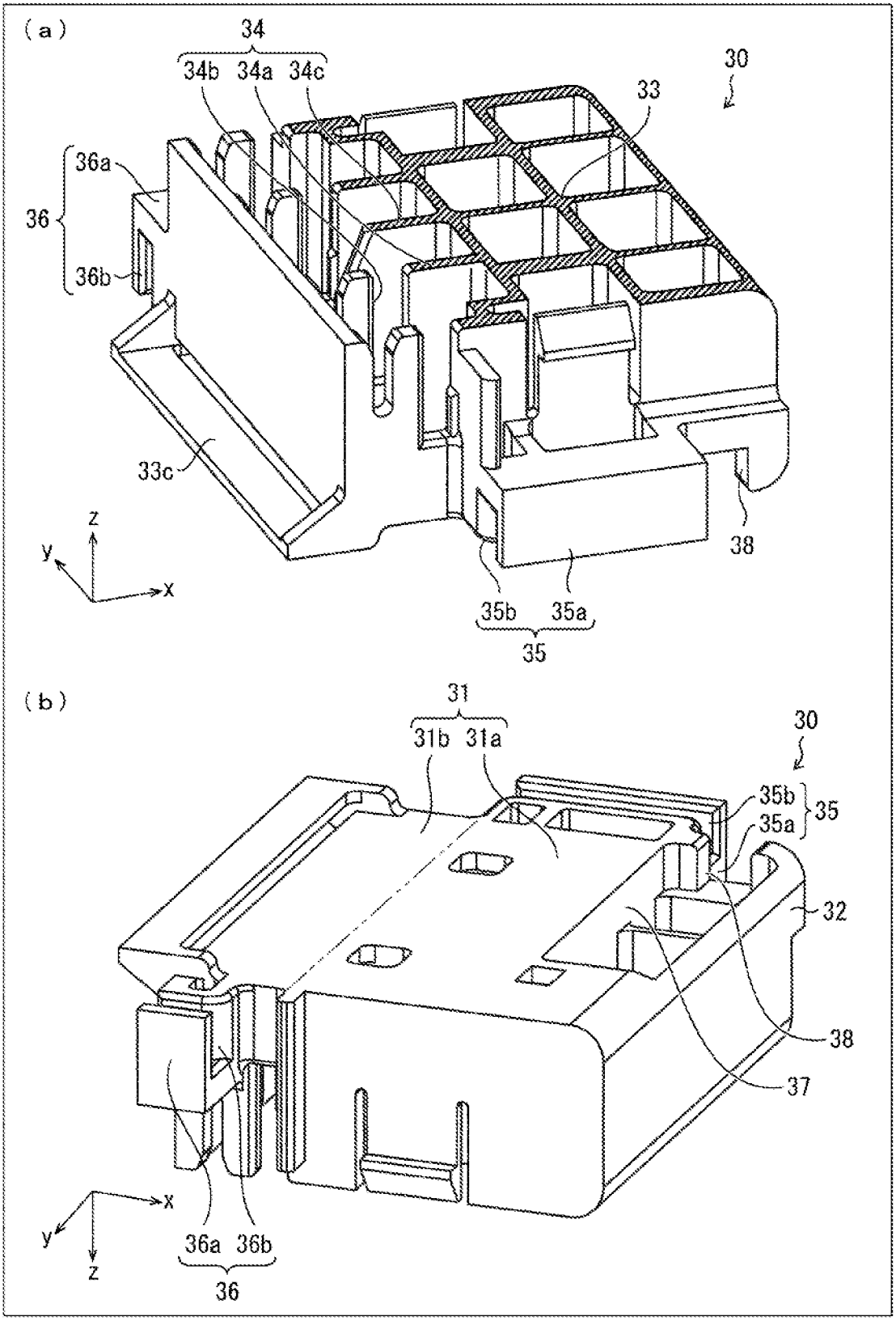

The following description will discuss, with reference to FIGS. 1 and 2, a configuration of an antenna device 1 including a film antenna 10 in accordance with an embodiment of the present invention. (a) of FIG. 1 is a perspective view of the antenna device 1. (b) of FIG. 1 is a development of the film antenna 10. (c) of FIG. 1 shows a plan view, a right side view, and a cross sectional view of the film antenna 10 wound around a support 30. (a) of FIG. 2 is a perspective view from the top side of the support 30 of the antenna device 1. (b) of FIG. 2 is a perspective view from the bottom side of the support 30. Note that first and second antenna elements 12 and 13 are not illustrated in (a) of FIG. 1, and the support 30 is not illustrated in (c) of FIG. 1. The cross sectional view in (c) of FIG. 1 shows a cross section which is along the line C-C', or the line D-D', indicated in (c) of FIG. 1 and which is viewed from the negative x-axis direction in the coordinate system indicated in (a) and (b) of FIG. 1.

As illustrated in (a) of FIG. 1, the antenna device 1 includes the film antenna 10, a coaxial cable 20, and the support 30. The coaxial cable 20 corresponds to the feed line recited in the claims. The film antenna 10 is wound around the support 30 so as to have a predetermined three-dimensional structure, which will be described later.

The coaxial cable 20 includes an inner conductor 21, an insulation layer 22, an outer conductor 23, and a jacket layer 24. The coaxial cable 20 is connected to a feed region 14 of the film antenna 10 (see (b) of FIG. 1). The coaxial cable 20 is held by the support 30 such that the coaxial cable 20 follows a predetermined wiring path. A configuration of the support 30 will be described later with reference to FIG. 2.

(Film Antenna 10)

A film antenna in accordance with an embodiment of the present invention includes a first antenna element and a second antenna element. The second antenna element includes a first sub-element (corresponding to the first portion recited in the claims) having a first resonance frequency and a second sub-element (corresponding to the second portion recited in the claims) having a second resonance frequency. The second resonance frequency is lower than the first resonance frequency. The second sub-element extends from the first sub-element in a direction away from a feed region. The first antenna element is disposed on a first plane. The first sub-element is disposed on a second plane which intersects the first plane. The second sub-element is disposed on a third plane which faces the first plane and which intersects the second plane. The second sub-element of the second antenna element is arranged such that, when the first antenna element is viewed from a direction orthogonal to the first plane, the second sub-element does not overlap the first antenna element except at an end region thereof. The end region is one of the opposite end portions, which is farther from the first sub-element, of the second sub-element.

The film antenna 10 is a concrete example of such a film antenna. As illustrated in (b) of FIG. 1, the film antenna 10 is a dipole antenna including a dielectric substrate 11, the first antenna element 12, and the second antenna element 13. Hereinafter, a region in which the gap between the first antenna element 12 and the second antenna element 13 is small will be referred to as the feed region 14. The coaxial cable 20 is connected to the feed region 14. More specifically, the outer conductor 23 of the coaxial cable 20 is soldered to a first connection point 14*a*, which is located on the first antenna element 12, and the inner conductor 21 of the coaxial cable 20 is soldered to a second connection point 14*b*, which is located on the second antenna element 13.

The dielectric substrate 11 is a flexible film substrate which is made of, for example, a polyimide resin. The first and second antenna elements 12 and 13 are pieces of flexible conductive foil which are provided on one surface of the dielectric substrate 11 and which are made of, for example, copper.

Since the dielectric substrate 11 and the first and second antenna elements 12 and 13 are all flexible, the film antenna 10 is also flexible. The film antenna 10 is therefore bendable into various shapes. The film antenna 10 is bent in a U shape, whose ridgelines are the line A-A' and the line B-B', and fixed to the support 30. The line A-A' transverses the first antenna element 12 and the second antenna element 13, and the line B-B' transverses the second antenna element 13.

The film antenna 10 can further include a dielectric substrate which covers the first and second antenna elements 12 and 13. That is, the film antenna 10 can be configured such that the antenna elements 12 and 13 are sandwiched between two dielectric films. By covering both surfaces of each of the first and second antenna elements 12 and 13 with dielectric films, it is possible to prevent, for example, damage to and deterioration of the first and second antenna elements 12 and 13.

(First Antenna Element 12)

The first antenna element 12 is disposed on a first plane P1. The first antenna element 12 includes a root portion 12*a*, a branch portion 12*b*, a narrow neck portion 12*c*, and a main portion 12*d*.

The root portion 12*a* extends from the feed region 14 in the negative x-axis direction (first direction) in the coordinate system indicated in (a) and (b) of FIG. 1 and is smaller in width in the y-axis direction (second direction), which intersects the x-axis direction, than the first sub-element 13*a*. The first direction refers to a direction which is parallel to the first plane P1 and a third plane P3 and which is away from a second plane P2. The second direction refers to a direction which is parallel to the first plane P1 and the third plane P3 and also parallel to the second plane P2.

The branch portion 12*b* is a strip-like conductor piece which extends, in the second direction, from an edge of the root portion 12*a* which edge is parallel to the first direction.

The narrow neck portion 12*c* is a strip-like conductor piece which extends from the farthest extremity (farthest edge) of the root portion 12*a* in the first direction. The narrow neck portion 12*c* is smaller in width in the second direction than the root portion 12*a*.

The main portion 12*d* is an elliptical conductor piece which is provided at one of the opposite ends, which is farther from the feed region 14, of the narrow neck portion.

The first antenna element 12 has a third resonance frequency different from first and second resonance frequencies (described later). The third resonance frequency is determined by a contour length which is a length from the first connection point 14*a* of the first antenna element 12 to the farthest extremity of the first antenna element 12 measured along the contour of the first antenna element 12. Because of this contour length, the third resonance frequency is lower than either of the first and second resonance frequencies. The third resonance frequency can be selected as appropriate based on desired radiation characteristics. The present embodiment employs 960 MHz as an example of the third resonance frequency.

(Second Antenna Element 13)

The second antenna element 13 is constituted by a first sub-element 13*a* and a second sub-element 13*b*.

The first sub-element 13*a* is at least partially disposed on the second plane P2, which intersects (in the present embodiment, which is orthogonal to) the first plane P1. In the present embodiment, the first sub-element 13*a* has: a region 13*a*1 which extends from the line A-A' to the line B-B'; a region which is included in the feed region 14; and a region 13*a*2 which extends from the line B-B' to the farthest extremity (farthest edge) of the first sub-element 13*a*. The region 13*a*1 is disposed on the second plane P2, the region included in the feed region 14 is disposed on the first plane P1, and the region 13*a*2 is disposed on the third plane P3.

The second sub-element 13*b* is disposed on the third plane P3, which faces the first plane P1 and which intersects (in the present embodiment, which is orthogonal to) the second plane P2. The second sub-element 13*b* is a strip-like conductor piece (first linear portion) which extends from the extremity (farthest edge) of the first sub-element 13*a* in the first direction (i.e., in the negative x-axis direction in the coordinate system indicated in (a) and (b) of FIG. 1).

The first sub-element 13*a* has the first resonance frequency. The first resonance frequency is determined by a contour length which is a length from the second connection point 14*b* of the second antenna element 13 to the farthest extremity (farthest edge) of the first sub-element 13*a* measured along the contour of the second antenna element 13. Note that the first sub-element 13*a* is an antenna element having a cup-like shape, whose width in the y-axis direction in the coordinate system indicated in (a) and (b) of FIG. 1 increases with increasing distance from the connection point 14*b* and then becomes constant.

The second sub-element 13*b* has the second resonance frequency. The second resonance frequency is determined by a contour length which is a length from the second connection point 14*b* to the farthest extremity (farthest edge) of the second sub-element 13*b* measured along the contour of the second antenna element 13. The second resonance frequency is lower than the first resonance frequency, because the contour length of the second sub-element 13*b* is greater than that of the first sub-element 13*a*. The first and second resonance frequencies can be selected as appropriate based on desired radiation characteristics. The present embodiment employs a frequency not lower than 2 GHz and not higher than 2.7 GHz as an example of the first resonance frequency, and 1.4 GHz as an example of the second resonance frequency.

As illustrated in the plan view in (c) of FIG. 1, when the first antenna element 12 is viewed from the z-axis direction in the coordinate system indicated in (a) and (b) of FIG. 1, the second sub-element 13*b* does not overlap the first antenna element 12 except at an end region 13*c*, which is the end portion opposite the first sub-element 13*a*-side end portion.

The film antenna 10 employs a configuration in which the end region 13*c* overlaps the branch portion 12*b* of the first antenna element 12. However, a film antenna in accordance with an embodiment of the present invention can alternatively employ, as will be described later with reference to FIG. 4, a configuration in which the end region 13*c* does not overlap the first antenna element 12, i.e., a configuration in which the second sub-element 13*b* does not overlap the first antenna element 12 at all.

(Effect of Film Antenna 10)

The film antenna 10 has a plurality of resonance frequencies (i.e., the first to third resonance frequencies). This allows the film antenna 10 to operate over a wide band. According to the film antenna 10, the first antenna element 12, the first sub-element 13*a*, and the second sub-element 13*b* are disposed on the first to third planes P1 to P3, respectively. This makes it possible to mount the film antenna 10 in a small space as compared with a film antenna unfolded and spread on a single plane.

Since the second sub-element 13*b* is arranged so as not to overlap the first antenna element 12 except at the end region 13*c*, it is also possible to reduce the parasitic capacitance between the second sub-element 13*b* and the first antenna element 12. This in turn makes it possible to prevent or reduce deterioration of the radiation characteristics of the film antenna 10.

According to the configuration of the film antenna 10, it is possible to provide a film antenna that can operate at a plurality of resonance frequencies, that is less prone to deterioration in radiation characteristics, and that can be mounted in a small space.

The end region 13*c* of the second sub-element 13*b* overlaps the branch portion 12*b* of the first antenna element 12. This allows the parasitic capacitance, which forms between the first antenna element 12 and the second antenna element 13, to occur not only in the feed region 14, in which the gap between first antenna element 12 and the second antenna element 13 is small, but also in the end region 13*c* of the second sub-element 13*b*.

It is known that the inductance matching between the coaxial cable 20 and the film antenna 10 depends on the parasitic capacitance between the first antenna element 12 and the second antenna element 13. With the film antenna 10 configured as described above, the inductance matching is improved and thereby the radiation characteristics of the film antenna are further improved, as compared with the case where the parasitic capacitance between the first antenna element and the second antenna element is formed only in the feed region.

The first plane P1 and the third plane P3 are preferably parallel to each other like those in the film antenna 10. With such a configuration, a distance d is constant regardless of the distance from the second plane. That is, the distance d does not decrease, and thus it is possible to prevent or reduce an increase, in the parasitic capacitance, which would be caused by a decreased distance d. Moreover, it is possible to prevent an increase, which would be caused by an increased distance d, in the space required for mounting the film antenna.

(Distance between First Plane P1 and Third Plane P3)

From the viewpoint of reducing the space required for mounting the film antenna 10, it is preferable that the distance between the first plane P1 and the third plane P3 (in other words, the distance between the line A-A' and the line B-B') is small. Hereinafter, this distance will be referred to as a height h of the film antenna 10.

However, the distance d between the root portion 12*a* of the first antenna element 12 and the second sub-element 13*b* (see the cross sectional view in (c) of FIG. 1) also decreases as the height h decreases.

Even in a case where a configuration in which the second sub-element 13*b* overlaps the first antenna element 12 only at the end region 13*c* is employed, the parasitic capacitance between the other region of the second sub-element 13*b* and the root portion 12*a* of the first antenna element 12 may increase if the distance d is excessively small. This leads to deterioration in radiation characteristics of the film antenna.

The inventors of the present invention have found that the deterioration in radiation characteristics can be sufficiently reduced by employing a configuration in which the distance d is 1/20 or more, more preferably 1/16 or more of the wavelength, in vacuum, of an electromagnetic wave which resonates at the second resonance frequency. The height h can be selected as appropriate, in consideration of the distance d, the width (i.e., a dimension in the y-axis direction) of the root portion 12*a*, and the like, such that the distance d satisfies the above requirement.

Note that the region 13*a*2 can be arranged to face the root portion 12*a* of the first antenna element 12, provided that the requirement on the distance d is satisfied and that the height his 1/20 or more of the wavelength, in vacuum, of an electromagnetic wave which resonates at the first resonance frequency (i.e., the resonance frequency of the first sub-element 13*a*). That is, the region 13*a*2, which is part of the first sub-element 13*a*, can be disposed on the third plane P3 (see the plan view in (c) of FIG. 1).

As long as the requirement on the distance d and the requirement on the height h are both satisfied, the radiation characteristics of the film antenna 10 do not deteriorate even if the region 13*a*2, which is part of the first sub-element 13*a*, is disposed on the third plane P3.

(Location of Feed Region 14)

The position where the feed region 14 is disposed in the film antenna 10 is not limited to positions on the first plane P1, and can alternatively be a position on the second plane P2 or the third plane P3. By selecting appropriate positions of the line A-A' and the line B-B' serving as ridgelines, it is possible to dispose the feed region 14 on any of the first to third planes P1 to P3.

However, from the viewpoint of improving the radiation characteristics, it is preferable that the feed region 14 is disposed on the first plane P1.

(Support 30)

As illustrated in FIG. 2, the support 30 is a structure having a first supporting face 31, a second supporting face 32 which intersects (in the present embodiment, which is orthogonal to) the first supporting face 31, and a third supporting face 33 which faces the first supporting face 31 and which intersects (in the present embodiment, which is orthogonal to) the second supporting face 32. The film antenna 10 is wound around the support 30 such that the front surface or the back surface of the film antenna 10 makes contact with the first supporting face 31, the second supporting face 32, and the third supporting face 33. In other words, the support 30 supports the film antenna 10 so that the film antenna 10 can maintain a predetermined shape.

The present embodiment employs, as the support 30, a molded resin product having a box-like shape illustrated in FIG. 2. The bottom face of the product serves as the first supporting face 31, the rear lateral face (i.e., one of the lateral faces which is positioned more downstream in the positive x-axis direction in the coordinate system indicated in (a) of FIG. 2) of the product serves as the second supporting face 32, and the top face of the product serves as the third supporting face 33. The molded resin product has lightening holes in its top face, and therefore the third supporting face 33 is constituted by top end faces (hatched with oblique lines in (a) of FIG. 2) of partition walls which are left unremoved. The first supporting face 31 of the support 30 protrudes forward (in the negative x-axis direction in the coordinate system indicated in (a) of FIG. 2) as compared with the third supporting face 33, and is divided into a counter region 31*a* and a non-counter region 31*b*. The counter region 31*a* faces a region in which the third supporting face 33 is provided, and the non-counter region 31*b* does not face the region in which the third supporting face 33 is provided.

The support 30 has a first holding portion 34, a second holding portion 35, and a third holding portion 36, each of which serves as a holding means for holding the coaxial cable 20 such that the coaxial cable 20 follows a predetermined wiring path and thereby enhancing the durability of the coaxial cable 20 against pulling.

The first supporting face 31 of the support 30 also has a first recess 37 and a second recess 38 which is in communication with the first recess 37 and which extends toward an edge of the first supporting face 31. The first and second recesses 37 and 38 house therein an end portion of the coaxial cable 20 connected to the feed region 14.

According to the antenna device 1, the film antenna 10 is attached to the support 30 such that the end portion of the coaxial cable 20 is housed in the first and second recesses 37 and 38 in the first supporting face 31. Furthermore, the film antenna 10 is wound around the support 30 such that the first plane P1, the second plane P2, and the third plane P3 make contact with the first supporting face 31, the second supporting face 32, and the third supporting face 33, respectively.

According to the above configuration of the antenna device 1, it is possible to provide an antenna device that includes a film antenna having a plurality of resonance frequencies, that is less prone to deterioration in radiation characteristics, and that can be mounted in a small space.

[Variation 1]

Figure 3:
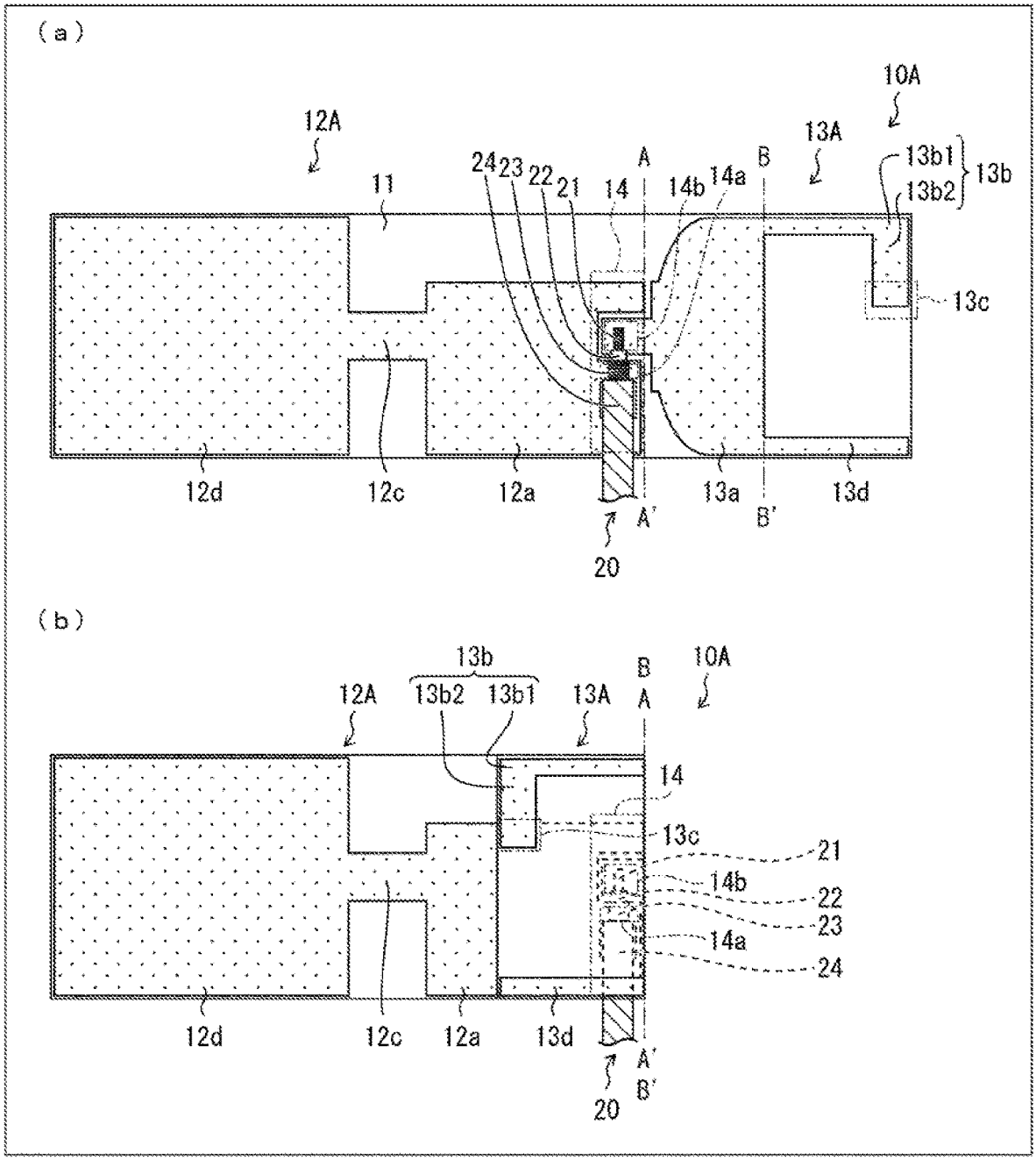

The following description will discuss, with reference to FIG. 3, a film antenna 10A which is Variation 1 of the film antenna 10. (a) of FIG. 3 is a development of the film antenna 10A. (b) of FIG. 3 is a plan view of the film antenna 10A wound around a support 30. The film antenna 10A is obtained by replacing the first and second antenna elements 12 and 13 of the film antenna 10 with first and second antenna elements 12A and 13A, respectively. Therefore, in Variation 1, only the first and second antenna elements 12A and 13A will be discussed. Members identical to those of the film antenna 10 are given the same reference signs, and the description thereof is omitted.

(First Antenna Element 12A)

The first antenna element 12A is obtained by removing the branch portion 12*b* from the first antenna element 12 and changing the shape of the main portion 12*d* from the elliptical shape to a rectangular shape.

(Second Antenna Element 13A)

The second antenna element 13A is obtained by changing the shape of the second sub-element 13*b* and adding a third sub-element (third portion) 13*d*.

A second sub-element 13*b* of Variation 1 is constituted by a first linear portion 13*b*1 and a second linear portion 13*b*2. The first linear portion 13*b*1 is a strip-like conductor piece which extends from an extremity of a first sub-element 13*a* in the first direction. The second linear portion 13*b*2 extends from an extremity of the first linear portion 13*b*1 in the second direction. The second sub-element 13*b* of Variation 1 is obtained by adding the second linear portion 13*b*2 to the second sub-element 13*b* of the film antenna 10 illustrated in FIG. 1.

The addition of the second linear portion 13*b*2 increases the contour length which is a length from a second connection point 14*b* to the farthest extremity (farthest edge) of the second sub-element 13*b* measured along the contour of the second antenna element 13. A second resonance frequency in Variation 1 is therefore lower than that of the film antenna 10.

As illustrated in the plan view in (b) of FIG. 3, when the first antenna element 12A is viewed from the z-axis direction in the coordinate system indicated in (a) and (b) of FIG. 1, the second sub-element 13*b* does not overlap the first antenna element 12 except at an end region 13*c*. The end region 13*c* overlaps a root portion 12*a* of the first antenna element 12*b*.

The third sub-element 13*d* is a strip-like conductor piece which extends from the extremity of the first sub-element 13*a* in the first direction. The third sub-element 13*d* has a fourth resonance frequency. The fourth resonance frequency is determined by a contour length which is a length from the second connection point 14*b* to the farthest extremity (farthest edge) of the third sub-element 13*d* measured along the contour of the second antenna element 13. Because of the contour length, the fourth resonance frequency is lower than a first resonance frequency and is higher than the second resonance frequency.

Variation 1 employs a configuration in which a height h of the film antenna 10A is 1/20 or more of the wavelength, in vacuum, of an electromagnetic wave which resonates at the fourth resonance frequency. Therefore, the radiation characteristics do not deteriorate even though the third sub-element 13*d* is disposed so as to overlap the root portion 12*a*.

Since the second sub-element 13*b* does not overlap the first antenna element 12 except at the end region 13*c* which overlaps the root portion 12*a*, the film antenna 10A brings about the same effect as that brought about by the film antenna 10.

[Variation 2]

Figure 4:
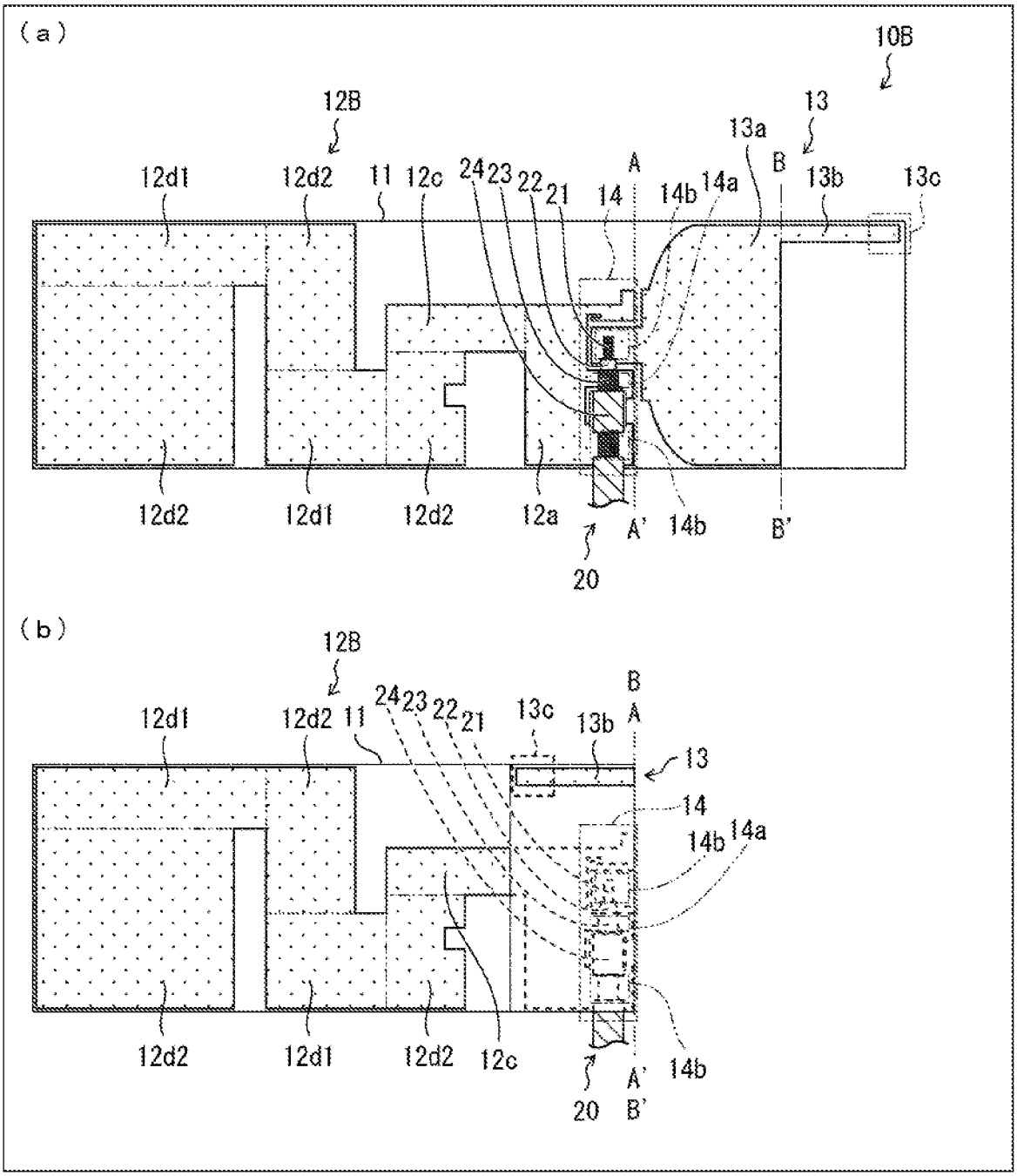

The following description will discuss, with reference to FIG. 4, a film antenna 10B which is Variation 2 of the film antenna 10. (a) of FIG. 4 is a development of the film antenna 10B. (b) of FIG. 4 is a plan view of the film antenna 10B wound around a support 30. The film antenna 10B is obtained by replacing the first antenna element 12 of the film antenna 10 with a first antenna element 12B. Therefore, in Variation 2, only the first antenna element 12B will be discussed. Members identical to those of the film antenna 10 are given the same reference signs, and the description thereof is omitted.

(First Antenna Element 12B)

The first antenna element 12B is obtained by removing the branch portion 12*b* from the first antenna element 12 and changing the shape of the main portion 12*d* from the elliptical shape to a meander shape.

A main portion 12*d* of Variation 2 is provided at an end portion (farthest extremity) of a narrow neck portion 12*c*, and includes alternately arranged first and second regions 12*d*1 and 12*d*2. The first regions 12*d*1 each extend in the first direction, and the second regions 12*d*2 each extend in the second direction.

As described above, the main portion 12*d* of the first antenna element 12B has a meander shape. In a case where the first antenna element 12B, in which the main portion 12*d* has a meander shape, is designed to have, for example, the same resonance frequency as that of a linear antenna element which extends only in the first direction, the first antenna element 12B can be mounted in a smaller space as compared with the linear antenna element.

On the other hand, the first antenna element 12B having a meander shape, which is to be mounted in, for example, the same size of space as the linear antenna element, can be designed to have a longer length and to thereby have a lower resonance frequency. This makes it possible to further broaden the operation band of the film antenna.

As illustrated in (b) of FIG. 4, an end region 13*c* can be arranged so as not to overlap the first antenna element 12B. According to this arrangement, it is possible to further reduce the parasitic capacitance between the first antenna element 12B and a second antenna element 13, as compared with a configuration in which the end region 13*c* overlaps the first antenna element 12 (e.g., the film antenna 10). The film antenna 10B can therefore be suitably used in a case where, for example, VSWR characteristics should be prioritized over radiation characteristics pattern.

[Example of Mounting on Vehicle Body]

Figure 5:
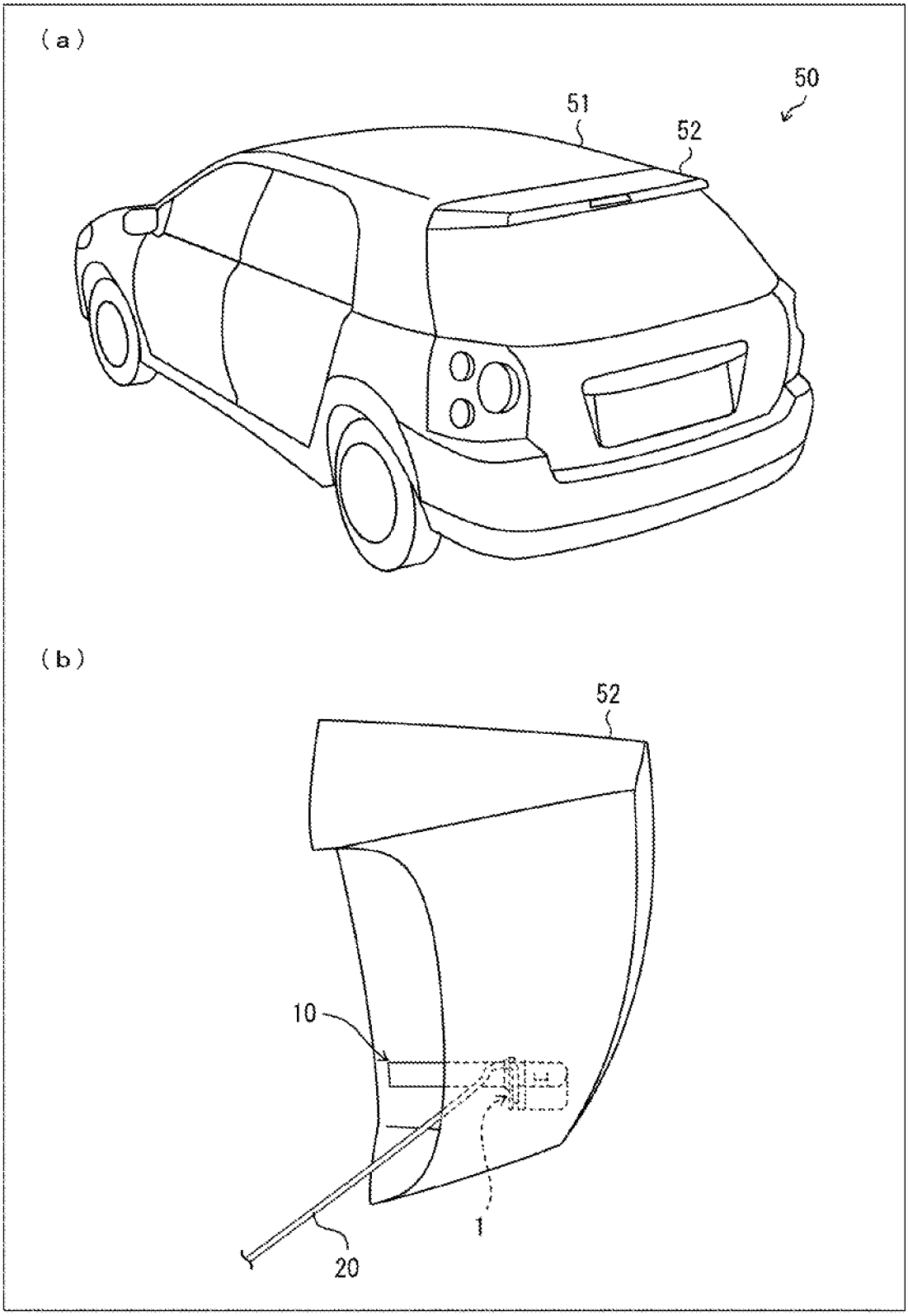

Although there is no limitation on an object on which the antenna device 1 is to be mounted, the antenna device 1 can be suitably mounted on, for example, a body of an automobile. The following description will discuss, with reference to FIG. 5, an example in which the antenna device 1 is mounted on a vehicle body. (a) of FIG. 5 is a perspective view of a vehicle body 50 which includes a spoiler 52 having the antenna device 1 therein. (b) of FIG. 5 is a perspective view of the spoiler 52.

As illustrated in (a) of FIG. 5, the spoiler 52 is provided at the rear end of a roof 51 of the vehicle body 50. The spoiler 52 is an integrally-molded resin member. The spoiler 52 has a structure to maintain a predetermined position of the spoiler 52 relative to the rear end of the roof 51, and has a structure to fix the spoiler 52 to the predetermined position on the roof 51. The structure to maintain a predetermined position of the spoiler 52 relative to the rear end of the roof 51 is, for example, a columnar protrusion (not illustrated in (b) of FIG. 9). The structure to fix the spoiler 52 to the predetermined position on the roof 51 is, for example, a bolt hole (not illustrated in (b) of FIG. 9). With those structures, the spoiler 52 is fixed to a predetermined position on the roof 51.

The spoiler 52 functions to, for example, suppress turbulent airflow (to make airflow unidirectional) at the rear end portion of the vehicle body 50 and to improve the appearance of the vehicle body 50. For making airflow unidirectional, the spoiler 52 is configured such that the vertical size of the spoiler 52 gradually decreases with decreasing distance to its rear end. That is, the spoiler 52 has a wedge shape which tapers from front to back and which has a space (i.e., a hollow structure) therein (see (b) of FIG. 5).

In this example of mounting, the spoiler 52 having the antenna device 1 therein is obtained by mounting the antenna device 1 in the above-described space as illustrated in (b) of FIG. 5. The antenna device 1 is mounted in the spoiler 52 such that (1) the first antenna element 12 of the film antenna 10 is in a higher position of the vehicle body 50 than the second sub-element 13*b* of the second antenna element 13 and (2) the first direction, in which the root portion 12*a* extends from the feed region 14*a*, is parallel to the direction in which the vehicle body 50 moves forward. On the basis of the coordinate system indicated in (a) of FIG. 1, the antenna device 1 mounted in the spoiler 52 has been rotated by 180 degrees about the x-axis such that the positive z-axis direction indicated in (a) of FIG. 1 matches the direction from the zenith toward the ground and such that the negative x-axis direction is parallel to the direction in which the vehicle body 50 moves forward.

Figure 6:
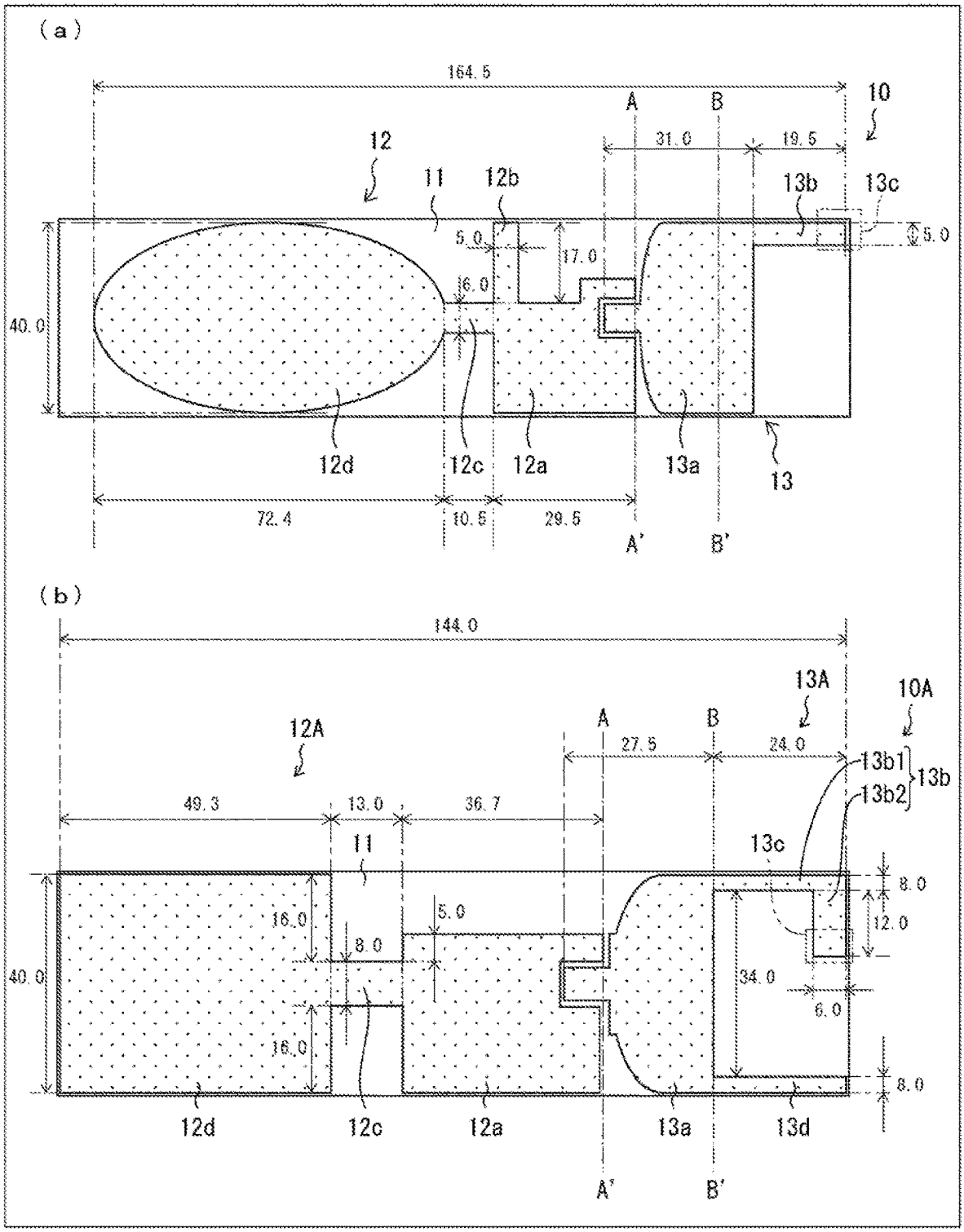

EXAMPLES (a) of FIG. 6 is a development of an Example (i.e., Example 1) of the film antenna 10. (b) of FIG. 6 is a development of an Example (i.e., Example 2) of the film antenna 10A. The example of the film antenna 10 is such that the size of each portion of the film antenna 10 described in the foregoing embodiment is defined as indicated in (a) of FIG. 6. Similarly, the example of the film antenna 10A is such that the size of each portion of the film antenna 10A described in Variation 1 is defined as indicated in (b) of FIG. 6.

Comparative Example

Figure 9:
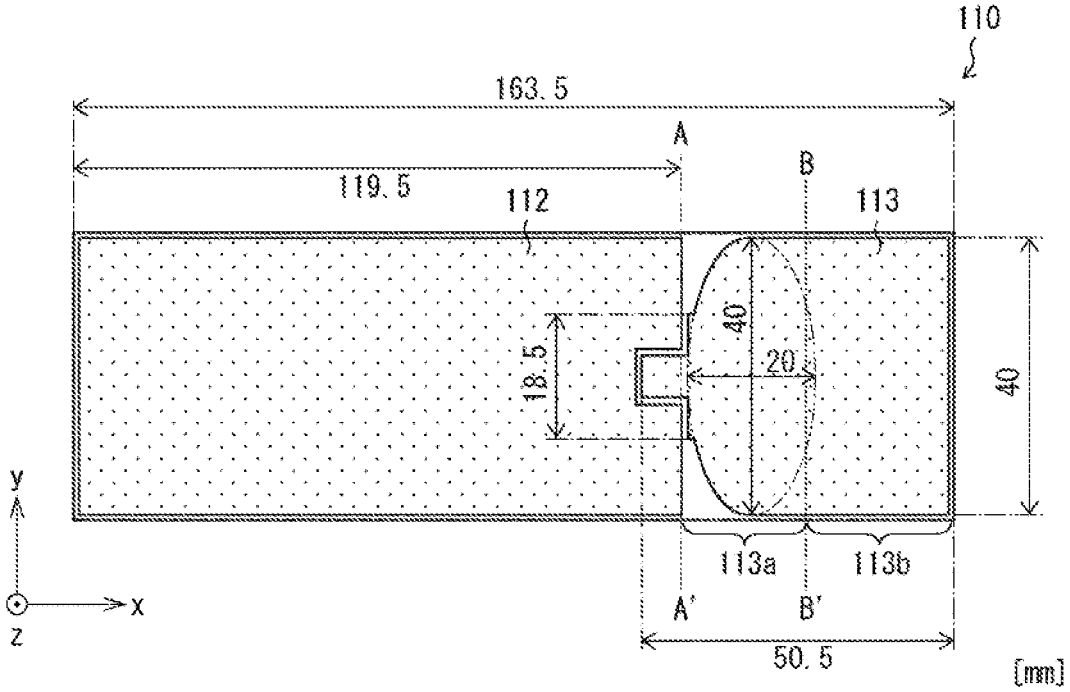
FIG. 9 is a development of the film antenna of Comparative Example.

A film antenna 110 illustrated in FIG. 9 was used as a Comparative Example. The film antenna 110 is obtained by replacing the first and second antenna elements 12 and 13 of the film antenna 10 with first and second antenna elements 112 and 113, respectively.

The first antenna element 112 is a strip-like conductor piece having a rectangular shape.

The second antenna element 113 is obtained by removing the second sub-element 13*b* from the second antenna element 13 and providing a rectangular conductor piece in a region 113*b* that extends from the line B-B' to an extremity (farthest edge) of the film antenna 110. A region 113*a* that extends from the line A-A' to the line B-B' corresponds to the region 13*a*1 of the second antenna element 13.

The film antenna 110 is configured such that the region 113*b* overlaps the first antenna element 112 when the film antenna 110 is wound around a support 30.

(Frequency Dependence of Gain)

Figure 7:
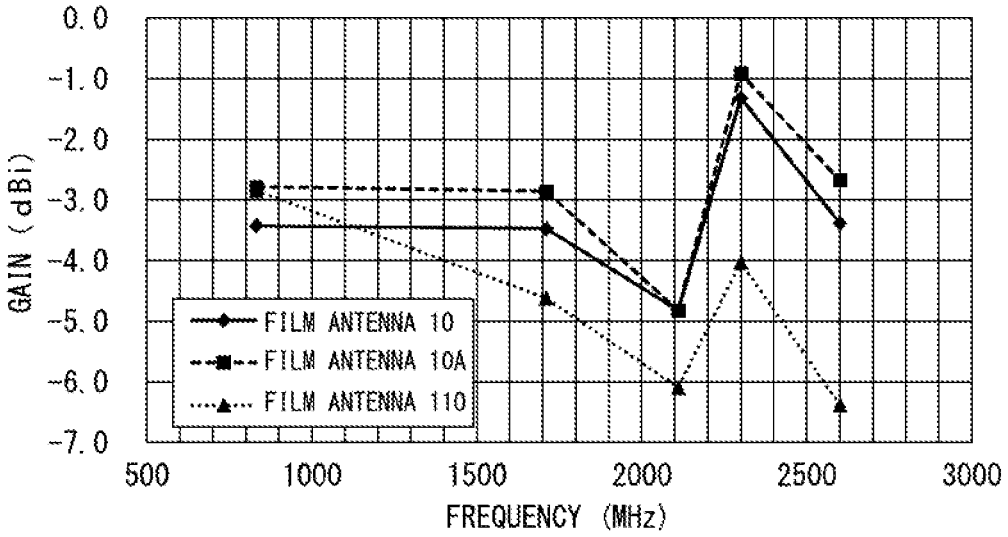
FIG. 7 is a graph showing the frequency dependence of gain of each of the film antennas of Examples illustrated in FIG. 6 and a Comparative Example illustrated in FIG. 9.

FIG. 7 is a graph showing frequency dependence of gain of each of the film antennas 10, 10A, and 110. The measurement of the frequency dependence of gain was carried out on the film antennas 10, 10A, and 110 each located within the spoiler 52 mounted on the vehicle body 50.

The gain of each film antenna indicated in FIG. 7 is a value obtained by measuring gains in the first plane P1 (in other words, a plane that is parallel to the roof 51 of the vehicle body 50) in all directions from the film antenna and integrating the gains thus measured. The measurement was carried out at frequencies of 832 MHz, 1.71 GHz, 2.11 GHz, 2.3 GHz, and 2.6 GHz.

The graph in FIG. 7 indicated that, at 832 MHz, the film antenna 110 exhibited a gain comparable to those of the film antennas 10 and 10A. However, the graph indicated that, in the frequency band of 1.71 GHz and higher, the gain of the film antenna 110 significantly deteriorated as compared with those of the film antennas 10 and 10A.

(Frequency Dependence of VSWR)

Figure 8:
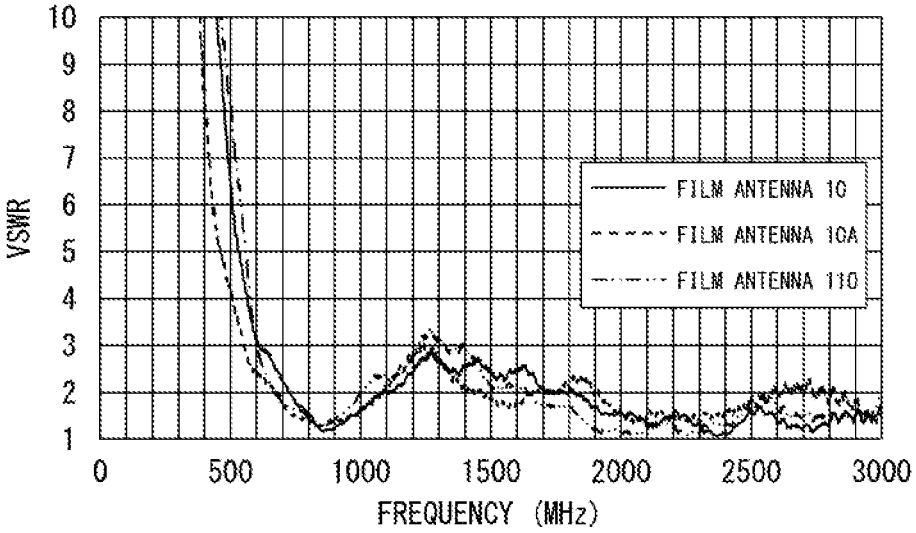
FIG. 8 is a graph showing the frequency dependence of VSWR of each of the film antenna of Examples illustrated in FIG. 6 and Comparative Example illustrated in FIG. 9.

FIG. 8 is a graph showing the frequency dependence of voltage standing wave ratio (VSWR) of each of the film antennas 10, 10A, and 110. The measurement of the frequency dependence of VSWR was carried out on the film antennas 10, 10A, and 110 each located within the spoiler 52 mounted on the vehicle body 50.

The graph in FIG. 8 indicated that, when attention was focused on the frequency band of from 1.2 GHz to 1.45 GHz, the VSWRs of the respective film antennas 10 and 10A were significantly reduced as compared with the VSRW of the film antenna 110. It is inferred that this effect is brought about by the configuration in which the second sub-element 13*b* does not overlap the first antenna element 12 except at the end region 13*c* and in which the end region 13*c* overlaps the branch portion 12*b* or the root portion 12*a* of the first antenna element 12. The graph also indicated that it is possible to broaden the VSWR characteristics band to the low-frequency side by employing a main portion 12*d* having an elliptical shape.

(Recap)

An antenna device in accordance with an aspect of the present invention includes: a first antenna element; and a second antenna element, the second antenna element including a first portion and a second portion, the first portion having a first resonance frequency, the second portion having a second resonance frequency which is lower than the first resonance frequency, the first antenna element being disposed on a first plane, the first portion of the second antenna element being disposed on a second plane, and the second portion of the second antenna element being disposed on a third plane, the second plane intersecting the first plane, the third plane facing the first plane and intersecting the second plane, when the first antenna element is viewed from a direction orthogonal to the first plane, the second portion of the second antenna element not overlapping the first antenna element except at an end region of the second portion, the end region being one of opposite end portions, which is farther from the first portion, of the second portion.

The film antenna configured as described above has the first resonance frequency and the second resonance frequency, that is, a plurality of resonance frequencies. Moreover, since the first antenna element, the first portion, and the second portion of the film antenna are disposed on the first to third planes, respectively, the film antenna can be mounted in a small space as compared with a film antenna unfolded and spread on a single plane.

Furthermore, since the film antenna is configured such that the second portion does not overlap the first antenna element except at the end region, it is possible to reduce the parasitic capacitance between the second portion and the first antenna element. This in turn makes it possible to prevent or reduce deterioration of the radiation characteristics of the film antenna.

The above configuration therefore makes it possible to provide a film antenna which has a plurality of resonance frequencies, which is less prone to deterioration in radiation characteristics, and which can be mounted in a small space.

A film antenna in accordance with an aspect of the present invention is configured such that: the first antenna element has a root portion and a branch portion, the root portion extending, in a first direction away from the second plane, from a feed region to which a feed line is to be connected, the root portion being smaller in width in a second direction than the first portion, the branch portion extending from the root portion in the second direction, the second direction intersecting the first direction; the second portion has a first linear portion which extends from an extremity of the first portion in the first direction when the first antenna element is viewed from the direction orthogonal to the first plane; and an end portion of the first linear portion, which end portion is the end region of the second portion, overlaps the branch portion when the first antenna element is viewed from the direction orthogonal to the first plane.

A film antenna in accordance with an aspect of the present invention is configured such that: the first antenna element has a root portion which extends, in a first direction away from the second plane, from a feed region to which a feed line is to be connected, the root portion being smaller in width in a second direction than the first portion, the second direction intersecting the first direction; the second portion has a first linear portion and a second linear portion, the first linear portion extending from an extremity of the first portion in the first direction when the first antenna element is viewed from the direction orthogonal to the first plane, the second linear portion extending from an extremity of the first linear portion in the second direction when the first antenna element is viewed from the direction orthogonal to the first plane; and an end portion of the second linear portion, which end portion is the end region of the second portion, overlaps the root portion when the first antenna element is viewed from the direction orthogonal to the first plane.

Since the end region of the second portion overlaps the first antenna element, the parasitic capacitance, which forms between the first antenna element and the second antenna element, to occur not only in the feed region, in which the gap between the first antenna element and the second antenna element is small, but also in the end region of the second antenna element.

It is known that the inductance matching between the feed line and the film antenna depends on the parasitic capacitance between the first antenna element and the second antenna element. With the above configuration, the inductance matching is improved and thereby the radiation characteristics of the film antenna are further improved, as compared with the case where the parasitic capacitance between the first antenna element and the second antenna element is formed only in the feed region.

A film antenna in accordance with an aspect of the present invention is configured such that: the first antenna element has a root portion which extends, in a first direction away from the second plane, from a feed region to which a feed line is to be connected, the root portion being smaller in width in a second direction than the first portion, the second direction intersecting the first direction; the second portion has a first linear portion which extends from an extremity of the first portion in the first direction when the first antenna element is viewed from the direction orthogonal to the first plane; and an end portion of the first linear portion, which end portion is the end region of the second portion, does not overlap the first antenna element.

As such, the end region of the second sub-element can be arranged so as not to overlap the first antenna element. According to this arrangement, it is possible to further reduce the parasitic capacitance between the first antenna element and the second antenna element, as compared with a configuration in which the end region overlaps the first antenna element. The film antenna can therefore be suitably used in a case where, for example, VSWR characteristics should be prioritized over radiation gain.

A film antenna in accordance with an aspect of the present invention is configured such that the first antenna element further has a narrow neck portion and a main portion, the narrow neck portion extending from the root portion in the first direction and being smaller in width in the second direction than the root portion, the main portion being located at an end of the narrow neck portion and including alternately arranged first and second regions, the first region (s) extending in the first direction, the second region(s) extending in the second direction.

As described above, the main portion of the first antenna element has a meander shape. In a case where the first antenna element, in which the main portion has a meander shape, is designed to have, for example, the same element length (i.e., the same resonance frequency) as that of a linear antenna element which extends only in the first direction, the first antenna element can be mounted in a smaller space as compared with the linear antenna element. Moreover, the first antenna element having a meander shape, which is to be mounted in, for example, the same size of space as the linear antenna element, can be designed to a larger length and thereby have a lower resonance frequency. This makes it possible to further broaden the operating band of the film antenna.

A film antenna in accordance with an aspect of the present invention is configured such that the first antenna element further has a narrow neck portion and a main portion, the narrow neck portion extending from the root portion in the first direction and being smaller in width in the second direction than the root portion, the main portion being located at an end of the narrow neck portion and having an elliptical shape.

Since the first antenna element has the narrow neck portion, an element length measured along the contour of the first antenna element is long as compared with a linear antenna element which extends only in the first direction. The film antenna configured as described above can therefore be mounted in a smaller space, in a case where the first antenna element is designed to have the same resonance frequency as that of the linear antenna element.

Moreover, since the main portion has an elliptical shape, radiation characteristics in the frequency band of the first antenna element are improved as compared with an antenna element whose main portion has a rectangular shape.

A film antenna in accordance with an aspect of the present invention is configured such that a distance between the root portion of the first antenna element and the second portion of the second antenna element is 1/20 or more of a wavelength, in vacuum, of an electromagnetic wave which resonates at the second resonance frequency.

The above configuration makes it possible to sufficiently reduce deterioration in radiation characteristics.

A film antenna in accordance with an aspect of the present invention is configured such that the first plane and the third plane are parallel to each other.

According to the above configuration, the distance between the root portion of the first antenna element and the second portion is constant regardless of the distance from the second plane. It is therefore possible to prevent or reduce an increase, in the parasitic capacitance, which would be caused by the decreased distance between the root portion of the first antenna element and the second portion. Moreover, it is possible to prevent an increase, which would be caused by the increased distance between the root portion of the first antenna element and the second portion, in space required for mounting the film antenna.

A film antenna in accordance with an aspect of the present invention is configured such that the feed region is disposed on the first plane.

The above configuration provides better radiation characteristics as compared with a configuration in which the feed region is disposed on the second plane.

An antenna device in accordance with an aspect of the present invention includes: a film antenna in accordance with any one of the aspects of the present invention; a feed line connected to the feed region of the film antenna; and a support that supports the film antenna, the support having a first supporting face, a second supporting face, and a third supporting face, the second supporting face intersecting the first supporting face, the third supporting face facing the first supporting face and intersecting the second supporting face, the film antenna being wound around the support such that the first plane makes contact with the first supporting face, the second plane makes contact with the second supporting face, and the third plane makes contact with the third supporting face.

The above configuration makes it possible to provide an antenna device which includes a film antenna having a plurality of resonance frequencies, which is less prone to deterioration in radiation characteristics, and which can be mounted in a small space.

The expression "winding a film antenna around a support" used herein means that the film antenna is deformed so as be guided along surfaces of the support, so that the film antenna is prevented from being detached from the support. Note that the expression above does not only contain the meaning of winding the film antenna around the support one or more turns. For example, in a case where the support is a member having a rectangular parallelepiped shape, examples of the forms meant by the expression encompass: (i) a form in which the film antenna is deformed so as to be guided along four faces (e.g. top face, right lateral face, bottom face, left lateral face) of the support so that the film antenna is prevented from being detached from the support, (ii) a form in which the film antenna is deformed so as to be guided along three faces (e.g. top face, right lateral face, bottom face) of the support so that the film antenna is prevented from being detached from the support, and (iii) a form in which the film antenna is deformed so as to be guided along two faces (e.g. top face, right lateral face) of the support so that the film antenna is prevented from being detached from the support.

The present invention is not limited to the embodiments, but can be altered by a skilled person in the art within the scope of the claims. An embodiment derived from a proper combination of technical means each disclosed in a different embodiment is also encompassed in the technical scope of the present invention.

REFERENCE SIGNS LIST

1: Antenna device
10, 10A, 10B: Film antenna
11: Dielectric substrate
12, 12A, 12B: First antenna element
12*a*: Root portion
12*b*: Branch portion
12*c*: Narrow neck portion
12*d*: Main portion
12*d*1: First region
12*d*2: Second region
13, 13A: Second antenna element
13*a*: First sub-element (first portion)
13*b*: Second sub-element (second portion)
13*c*: End region
14: Feed region
14*a*: First connection point
14*b*: Second connection point
P1: First plane
P2: Second plane
P3: Third plane
20: Coaxial cable (feed line)
21: Inner conductor
22: Insulation layer
23: Outer conductor
24: Jacket layer
30: Support
31: First supporting face
32: Second supporting face
33: Third supporting face

The invention claimed is:

1. A film antenna, comprising:

a first antenna element; and a second antenna element, the second antenna element including a first portion and a second portion, the first portion having a first resonance frequency, the second portion having a second resonance frequency which is lower than the first resonance frequency, the first antenna element being disposed on a first plane, the first portion of the second antenna element being disposed on a second plane, and the second portion of the second antenna element being disposed on a third plane, the second plane intersecting the first plane, the third plane facing the first plane and intersecting the second plane, when the first antenna element is viewed from a direction orthogonal to the first plane, the second portion of the second antenna element not overlapping the first antenna element except at an end region of the second portion, the end region being one of opposite end portions, which is farther from the first portion, of the second antenna element, wherein the first antenna element and the second antenna element are each a single piece of conductive foil.

2. The film antenna as set forth in claim 1, wherein:

the first antenna element has a root portion and a branch portion, the root portion extending, in a first direction away from the second plane, from a feed region to which a feed line is to be connected, the root portion being smaller in width in a second direction than the first portion, the branch portion extending from the root portion in the second direction, the second direction intersecting the first direction;

the second portion has a first linear portion which extends from an extremity of the first portion in the first direction when the first antenna element is viewed from the direction orthogonal to the first plane; and an end portion of the first linear portion, which end portion is the end region of the second portion, overlaps the branch portion when the first antenna element is viewed from the direction orthogonal to the first plane.

3. The film antenna as set forth in claim 1, wherein:

the first antenna element has a root portion which extends, in a first direction away from the second plane, from a feed region to which a feed line is to be connected, the root portion being smaller in width in a second direction than the first portion, the second direction intersecting the first direction;

the second portion has a first linear portion and a second linear portion, the first linear portion extending from an extremity of the first portion in the first direction when the first antenna element is viewed from the direction orthogonal to the first plane, the second linear portion extending from an extremity of the first linear portion in the second direction when the first antenna element is viewed from the direction orthogonal to the first plane; and an end portion of the second linear portion, which end portion is the end region of the second portion, overlaps the root portion when the first antenna element is viewed from the direction orthogonal to the first plane.

4. The film antenna as set forth in claim 1, wherein:

the first antenna element has a root portion which extends, in a first direction away from the second plane, from a feed region to which a feed line is to be connected, the root portion being smaller in width in a second direction than the first portion, the second direction intersecting the first direction;

the second portion has a first linear portion which extends from an extremity of the first portion in the first direction when the first antenna element is viewed from the direction orthogonal to the first plane; and an end portion of the first linear portion, which end portion is the end region of the second portion, does not overlap the first antenna element.

5. The film antenna as set forth in claim 2, wherein the first antenna element further has a narrow neck portion and a main portion, the narrow neck portion extending from the root portion in the first direction and being smaller in width in the second direction than the root portion, the main portion being located at an end of the narrow neck portion and including alternately arranged first and second regions, the first region(s) extending in the first direction, the second region(s) extending in the second direction.

6. The film antenna as set forth in claim 2, wherein the first antenna element further has a narrow neck portion and a main portion, the narrow neck portion extending from the root portion in the first direction and being smaller in width in the second direction than the root portion, the main portion being located at an end of the narrow neck portion and having an elliptical shape.

7. The film antenna as set forth in claim 2, wherein the first plane and the third plane are parallel to each other.

8. The film antenna as set forth in claim 2, wherein the feed region is disposed on the first plane.

9. An antenna device, comprising:

the film antenna as set forth in claim 2;

a feed line connected to the feed region of the film antenna; and a support that supports the film antenna, the support having a first supporting face, a second supporting face, and a third supporting face, the second supporting face intersecting the first supporting face, the third supporting face facing the first supporting face and intersecting the second supporting face, the film antenna being wound around the support such that the first plane makes contact with the first supporting face, the second plane makes contact with the second supporting face, and the third plane makes contact with the third supporting face.

* * * * *